United States Patent [19]

Timoschuk

[11] Patent Number: 4,519,556

[45] Date of Patent: May 28, 1985

[54] UNIVERSAL CABLE WINDING DRUM

[76] Inventor: Walter Timoschuk, 19 Place de Bohéme, Candiac, Quebec, Canada, J5R 3N2

[21] Appl. No.: 632,430

[22] Filed: Jul. 19, 1984

[30] Foreign Application Priority Data

Jun. 19, 1984 [CA] Canada ..... 456935

[51] Int. Cl.[3] ..... B66D 1/36

[52] U.S. Cl. ..... 242/117

[58] Field of Search ..... 242/117; 29/121.4, 121.6, 29/121.7, 121.1; 72/280, 289; 254/373, 374

[56] References Cited

U.S. PATENT DOCUMENTS

| | | | |
|---|---|---|---|
| 823,401 | 6/1906 | Ferris | 242/117 |
| 3,025,015 | 3/1962 | Mix | 29/121.4 X |
| 3,374,648 | 3/1968 | Maguire | 29/121.4 X |

FOREIGN PATENT DOCUMENTS

| | | | |
|---|---|---|---|
| 1197535 | 12/1957 | France | 242/117 |
| 437707 | 3/1975 | U.S.S.R. | 242/117 |
| 743946 | 6/1980 | U.S.S.R. | 242/117 |

*Primary Examiner*—John M. Jillions
*Assistant Examiner*—Lloyd D. Doigan
*Attorney, Agent, or Firm*—Oblon, Fisher, Spivak, McClelland & Maier

[57] ABSTRACT

A universal cable winding drum for winding and unwinding a cable connected thereto. The drum has a hollow central hub for securement to a rod associated with a winding mechanism to impart rotation to the drum. A cylindrical cable supporting wall is connected to the hub and extends thereabout for supporting a plurality of windings of a cable thereon. The cable supporting wall has a plurality of cable guide channels formed therein in side-by-side relationship and are interspaced at overlapping end regions whereby to constitute right and left hand cable guide channels so that the cable can be wound thereon from either side of the drum. The end of the cable is secured through an end one of the channels on the cylindrical wall of the drum.

9 Claims, 4 Drawing Figures

UNIVERSAL CABLE WINDING DRUM

BACKGROUND OF INVENTION (a) Field of the Invention

The present invention relates to a cable winding drum as utilized in a door raising and lowering mechanism and wherein the drum of the present invention is provided with universal cable guide channels whereby to accept a cable winding from either the right or left hand side so that the drum may be used on either side of the door.

(b) Description of Prior Art

In a door raising and lowering system there is usually provided two cable winding drums, one positioned on each top side of the door. A steel cable is secured at one end to the bottom of the door and at the upper end to the drum. When the door is lowered or raised the drum is rotated and the cable is unwound or wound about the drum.

SUMMARY OF INVENTION

It is a feature of the present invention to provide an improved cable winding drum and wherein the drum is provided with right and left hand cable guide channels to form a universal drum whereby a single drum may be used and installed on either the right or left side of the door.

Another feature of the present invention is to provide a universal cable winding drum providing a faster installation of a door raising and lowering mechanism and eliminating errors in packaging and also providing for a reduction in manufacturing costs and a reduction in inventory costs.

Another feature of the present invention is to provide a universal cable winding drum in which there is provided adjustable cable securement means.

According to the above features, from a broad aspect, the present invention provides a universal cable winding drum for winding and unwinding a cable connected thereto. The drum has a hollow central hub for securement to a rod associated with winding means to impart rotation to the drum. A cylindrical cable supporting wall is connected to the hub and extends thereabout for supporting a plurality of windings of a cable thereon. The cable supporting wall has a plurality of cable guide channels formed therein in side-by-side relationship. The channels define valleys and side peaks with the valleys diminishing in depth from diametrically opposed points on respective opposed half-sections of the drum to an intermediate mid-area on diametrically opposed sides of the cable supporting wall where said peaks of the channels of one of said half-sections are interspaced and overlap in length with the peaks of the other half-section and taper within the drum table supporting wall. The channels thus constitute right and left hand cable guide channels. Means is provided to secure an end of the cable to the drum.

BRIEF DESCRIPTION OF DRAWINGS

A preferred embodiment of the present invention will now be described with reference to an example thereof illustrated in the accompanying drawings in which.

DESCRIPTION OF PREFERRED EMBODIMENTS

Figure 2:
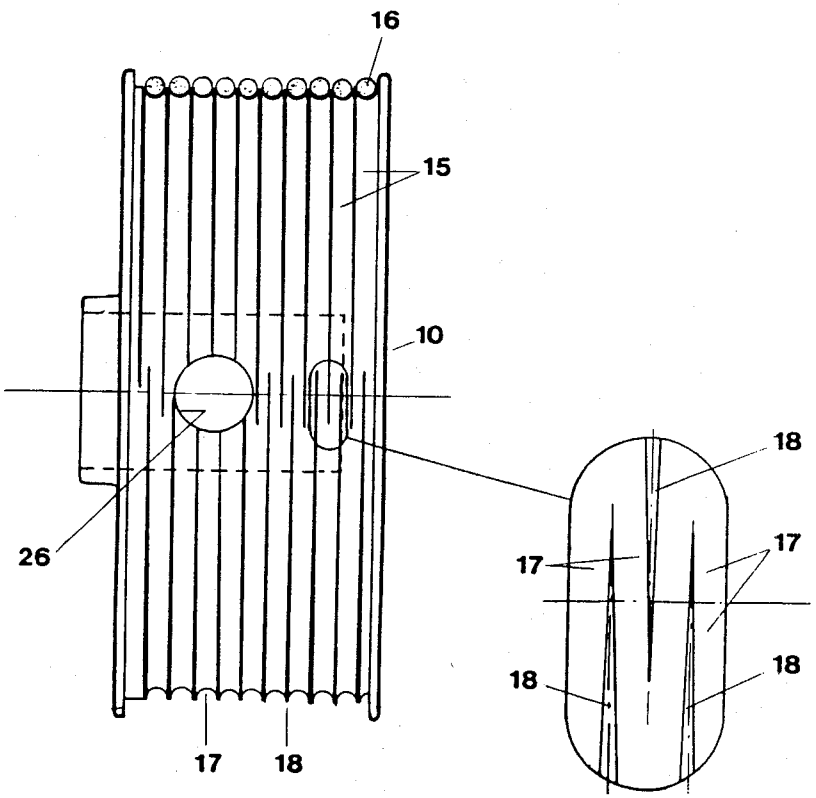
FIG. 2 is a side view of the drum showing an enlarged area thereof.

Referring now to the drawings, there is shown generally at 10 the universal cable winding drum of the present invention. The drum comprises a hollow central hub 11 which is adapted for securement to a support rod (not shown) which is usually associated with a coil spring thereabout to impart rotation to the drum. The drum has a cylindrical cable supporting wall 12 connected to the hub by spokes 13 thus to form a drum with a hollow interior 14.

Figure 1:
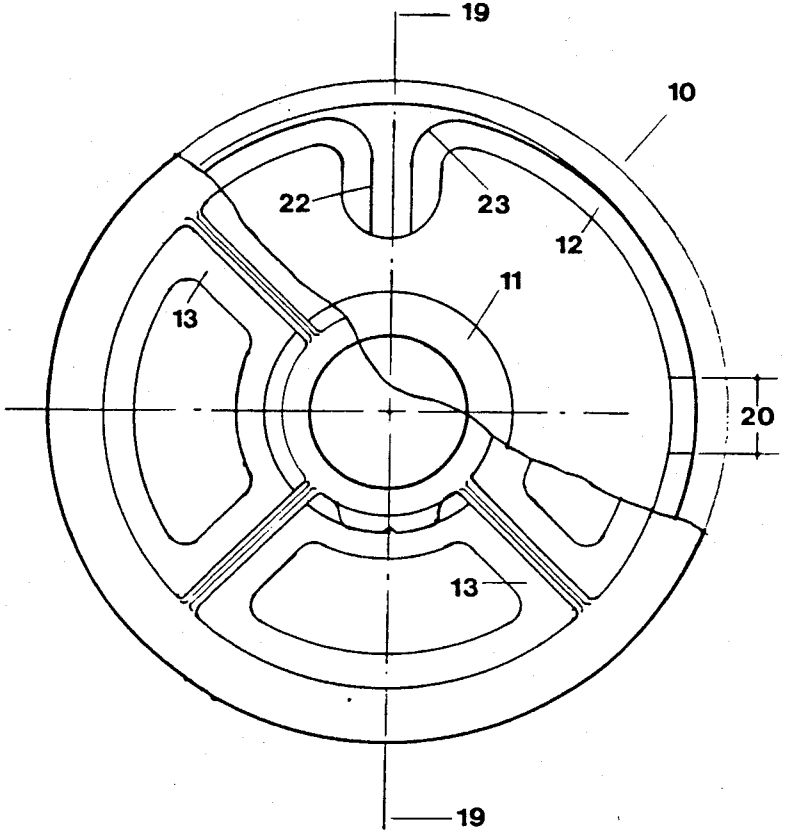
FIG. 1 is a fragmented front view of the universal cable winding drum of the present invention.
Figure 4:
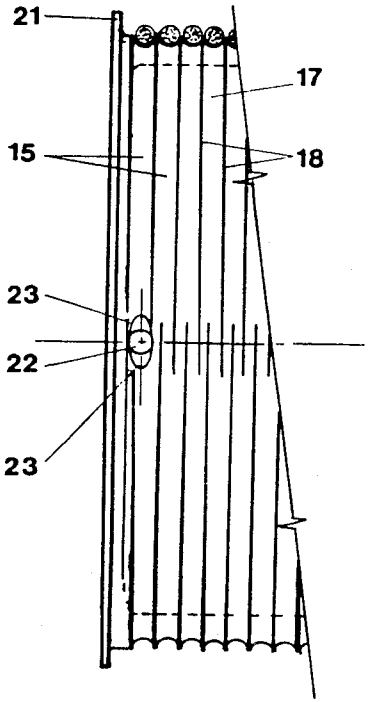
FIG. 4 is a fragmented side view of the drum.
Figure 3:
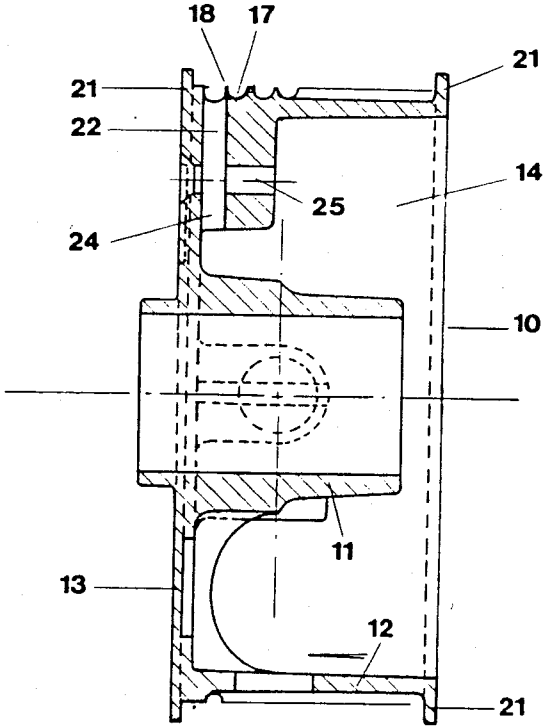
FIG. 3 is a section side view through the drum.

The cylindrical cable supporting wall 12 extends concentrically about the hub 11 and is provided with a plurality of cable guide channels 15 whereby to support a plurality of windings of a cable 16 thereon. The cable guide channels 15 are formed in the supporting wall 12 in side-by-side relationship and define valleys and side peaks 17 and 18 respectively. The valleys diminish in depth from diametrically opposed points, herein defined by axis 19 in FIG. 1, on respective half-sections of the drum to an intermediate mid-area 20 on diametrically opposed sides of the cable supporting wall.

As can be seen clearly in FIG. 2, the peaks 18 of the channels 15 in one of the half-sections of the drum are interspaced and overlap in length with the peaks of the channels in the other half-section and taper within the drum cable supporting wall surface. Thus, as is clearly seen in this Figure, the pulley can accept a winding of the cable 16 from either direction and thus the drum can be used as either a right hand drum or left hand drum. It can be seen that the peaks 18 of the cable guide channels 15 in each half-section of the drum are disposed substantially parallel to one another and slightly angulated toward their intermediate mid-area 20. Because the peaks in the mid-area 20 are substantially flush with the outer surface of the wall 12, the cable 16 wound thereon can cross over to the guide channels 15 from one half-section of the drum to the other.

In order to prevent the cable 16 wound on the drum cable supporting wall from slipping off the wall, there is provided an end flange 21 formed integral with the supporting wall and disposed at each side thereof. In fact, the entire drum is formed as an integral part and is preferably, although not exclusively, made as a die cast of aluminum thus making the drum strong and lightweight.

In order to secure the cable 16 to the drum, there is provided a cable entry hole 22 which is formed transverse in an end one of the cable guide channels 15. The entry end of the entry hole 22 has opposed curved tapers 23 to define a flared end thus providing a smooth curved support surface for the cable at its entry point into the hole 22 whereby to prevent the cable from kinking and breaking in that region (see FIG. 1). The entry hole 22 is provided with an exit end 24 intermediate the hub 11 and the support wall 12 whereby a cable securing end will exit through the hollow interior 14 to permit access thereto such that a pulling tool, i.e. a pair of pliers, can be inserted to pull the wire taut through the cable entry hole 22. A threaded bore 25 is provided in intersecting relationship to the entry hole 22 and receives therein an arresting fastener (not shown) whereby the fastener can arrest the cable end in the entry hole 22 once it has been properly adjusted.

As shown in FIG. 2, an access hole 26 may also be provided in the cable supporting wall 12 to provide access to a fastener secured to the hub 11 to mount the pulley on its support rod (not shown). Further modifications to the drum are foreseeable and it is within the ambit of the present invention to cover these, provided they fall within the scope of the appended claims.

I claim:

1. A universal cable winding drum for winding and unwinding a cable connected thereto, said drum having a hollow central hub for securement to a rod associated with winding means to impart rotation to said drum, and a cylindrical cable supporting wall connected to said hub and extending thereabout for supporting a plurality of windings of a cable thereon, said cable supporting wall having a plurality of cable guide channels formed therein in side-by-side relationship, said channels defining valleys and side peaks, said valleys diminishing in depth from diametrically opposed points on respective opposed half-sections of said drum to an intermediate mid-area on diametrically opposed sides of said cable supporting wall where said peaks of said channels of one of said half-sections are interspaced and overlap in length with said peaks of said other half-section and taper within said drum cable supporting wall surface, said channels constituting right and left hand cable guide channels, and means to secure an end of said cable to said drum,.

2. A universal cable winding drum as claimed in claim 1 wherein there is further provided an end flange on opposed side edges of said cable supporting wall and extending above said cable guide channels.

3. A universal cable winding drum as claimed in claim 2 wherein said peaks of said cable guide channels in each half-section are disposed substantially parallel to one another and slightly angulated toward said intermediate mid-area to a common side of said drum.

4. A universal cable winding drum as claimed in claim 1 wherein said means to secure an end of said cable is constituted by a cable entry hole provided in an end one of said cable guide channels, and means to secure said cable end in said entry hole.

5. A universal cable winding drum as claimed in claim 4 wherein said cable entry hole is provided with a flared entry end defining opposed curved tapers disposed in said end one of said cable guide channels on each opposed side of said entry hole to provide a smooth curved support surface for said cable when entering said entry hole from either side.

6. A universal cable winding drum as claimed in claim 4 wherein said entry hole has an exit end intermediate said hub and cable supporting wall, and a threaded bore in intersecting relationship with said entry hole to receive an arresting fastener therein whereby to arrest said cable end in said entry hole.

7. A universal cable winding drum as claimed in claim 6 wherein the free end of said cable end extends into a hollow space intermediate said hub and cable supporting wall for access thereto to permit said cable end to be adjustably positioned in said entry hole thus providing with said arresting fastener an adjustable cable end securement means.

8. A universal cable winding drum as claimed in claim 1 wherein said drum is for use in a door raising and lowering system, said drum being positionable on the right or left hand side of said door.

9. A universal cable winding drum as claimed in claim 8 wherein said drum is an aluminum die cast drum of light-weight construction.

* * * * *